US006658815B1

(12) United States Patent
Gaspar

(10) Patent No.: US 6,658,815 B1
(45) Date of Patent: Dec. 9, 2003

(54) BOTTLE CARRIER SYSTEM

(76) Inventor: Jose F. Gaspar, 150 Potter St., South Darthmouth, MA (US) 02748

( * ) Notice: Subject to any disclaimer, the term of this patent is extended or adjusted under 35 U.S.C. 154(b) by 57 days.

(21) Appl. No.: 10/071,460

(22) Filed: Feb. 8, 2002

(51) Int. Cl.[7] ..... B65D 27/04
(52) U.S. Cl. ..... 53/390; 53/48.1; 53/398
(58) Field of Search ..... 53/48.1, 142, 390, 53/398; 206/151, 161

(56) References Cited

U.S. PATENT DOCUMENTS

| | | | | | |
|---|---|---|---|---|---|
| 3,307,321 | A | | 3/1967 | Beart | |
| 4,641,483 | A | * | 2/1987 | Yamauchi | 53/390 |
| 4,848,061 | A | | 7/1989 | Le Bras | |
| D331,698 | S | | 12/1992 | Pezzoli et al. | |
| 5,191,975 | A | | 3/1993 | Pezzoli et al. | |
| 5,237,796 | A | * | 8/1993 | Bonkowski | 53/398 |
| 5,263,299 | A | * | 11/1993 | Galbierz et al. | 53/48.1 |
| 5,537,801 | A | | 7/1996 | Granbakken et al. | |
| 5,791,121 | A | | 8/1998 | Bernier | |
| 5,806,416 | A | * | 9/1998 | Cerniglia et al. | 100/90 |
| 6,076,331 | A | * | 6/2000 | Granbakken et al. | 53/398 |

* cited by examiner

*Primary Examiner*—David T. Fidei

(57) ABSTRACT

A bottle carrier system for enabling a user to quickly and easily divide bottled beverages into six packs. The bottle carrier system includes a plurality of bottles. A bottle carrier has a plurality of apertures, each aperture is structured to frictionally engage a top of an associated one of the plurality of bottles when the top of the associated one of the bottles is inserted through the aperture. A rigid planar member has a plurality of holes. Each of the holes is positioned to align with an associated one of the apertures when the rigid planar member is positioned over the bottle carrier, whereby applying a downward force to the rigid planar member when the bottle carrier is positioned between the plurality of bottles and the rigid planar member urges the top of each the bottle through the associated aperture to secure the bottle carrier to the plurality of bottles.

6 Claims, 2 Drawing Sheets

BOTTLE CARRIER SYSTEM

BACKGROUND OF THE INVENTION

1. Field of the Invention

The present invention relates to bottle carrier systems and more particularly pertains to a new bottle carrier system for enabling a user to quickly and easily divide bottled beverages into six packs.

2. Description of the Prior Art

The use of bottle carrier systems is known in the prior art. U.S. Pat. No. 3,946,862 describes a container package having a plurality of containers. Another type of bottle carrier systems is U.S. Pat. No. 3,633,962 describing a bottle carrier for supporting a plurality of bottles. U.S. Pat. No. 5,413,395 describes a carrier for bottles and like containers. U.S. Pat. No. 3,912,075 describes a plastic carrier for containers. U.S. Pat. No. 4,235,468 describes an integrally formed bottle carrier in which an upper frame contains a plurality of bottle supporting collars for receiving and supporting the necks of bottles. U.S. Pat. No. Des. 407,637 describes an ornamental design for a container carrier.

While these devices fulfill their respective, particular objectives and requirements, the need remains for a device that would allow a retailer to create their own six-pack of beverages.

SUMMARY OF THE INVENTION

The present invention meets the needs presented above by providing a user with a beverage carrier that would allow the user to create custom beverage packs.

An object of the present invention is to provide a new bottle carrier system that would eliminate the need to press the tray into place with the fingers and could eliminate cuts caused by the sharp-edged bottle caps.

Even still another object of the present invention is to provide a new bottle carrier system that would be easy to use and simple to place and remove.

To this end, the present invention generally comprises a plurality of bottles. A bottle carrier has a plurality of apertures, each aperture is structured to frictionally engage a top of an associated one of the plurality of bottles when the top of the associated one of the bottles is inserted through the aperture. A rigid planar member has a plurality of holes. Each of the holes is positioned to align with an associated one of the apertures when the rigid planar member is positioned over the bottle carrier, whereby applying a downward force to the rigid planar member when the bottle carrier is positioned between the plurality of bottles and the rigid planar member urges the top of each the bottle through the associated aperture to secure the bottle carrier to the plurality of bottles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
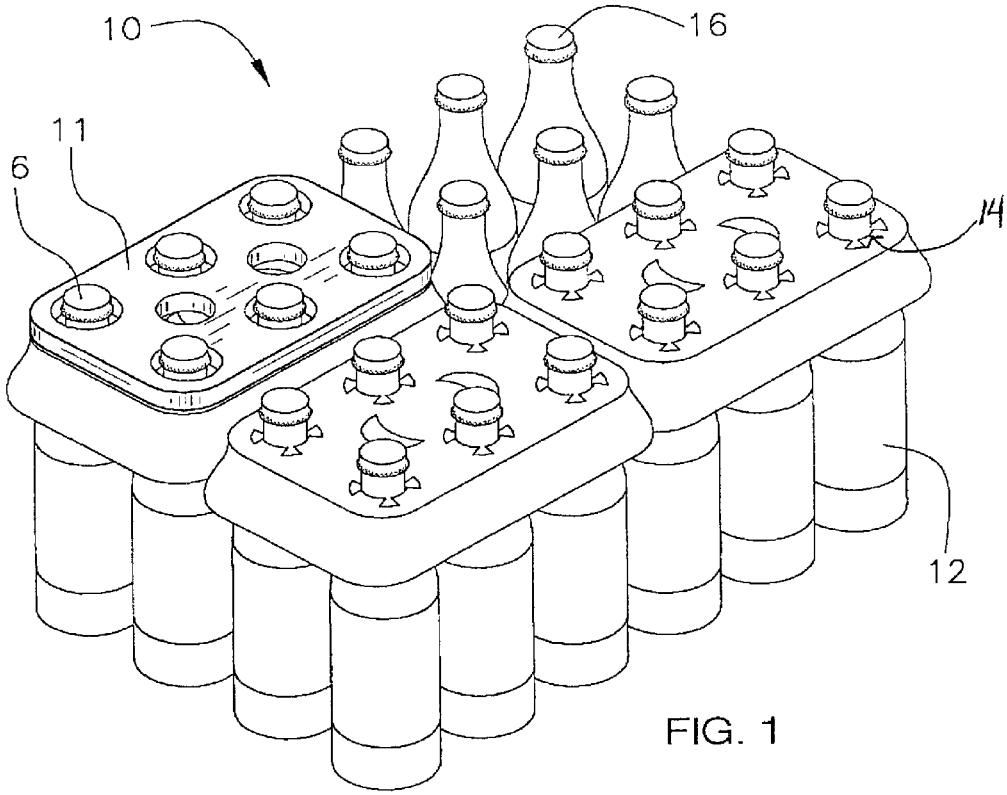
FIG. 1 is a perspective view of a new bottle carrier system according to the present invention.
Figure 2:
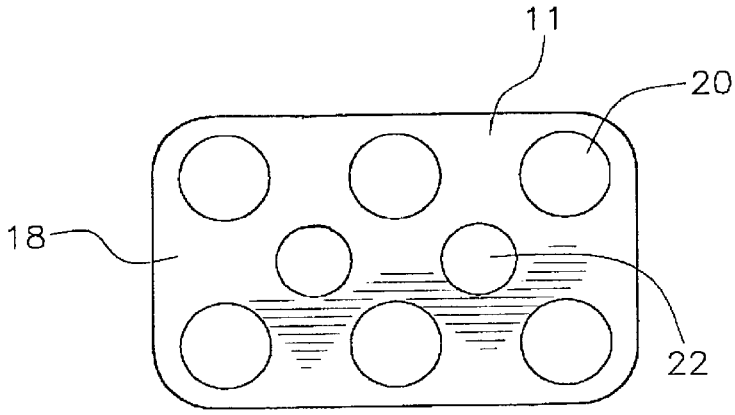
FIG. 2 is a top view of the present invention.
Figure 3:
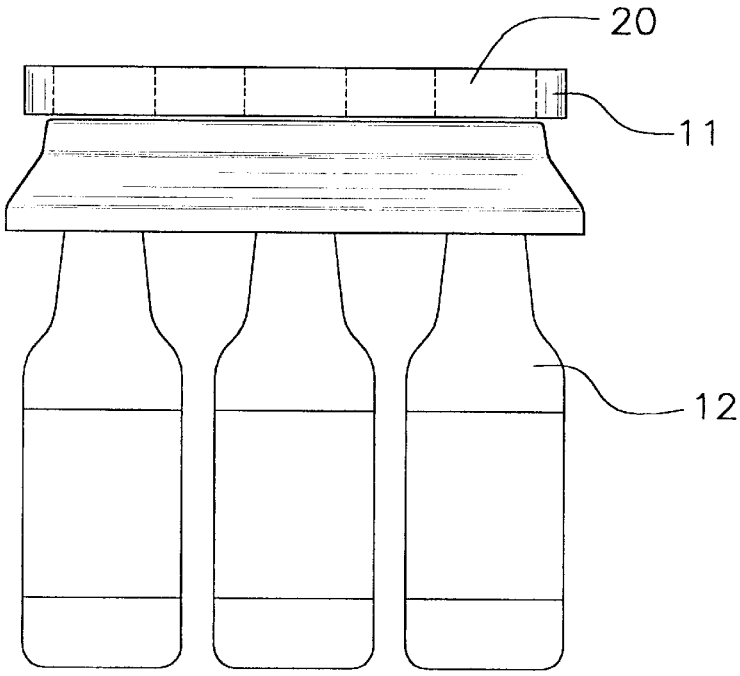
FIG. 3 is a side view of the present invention.
Figure 4:
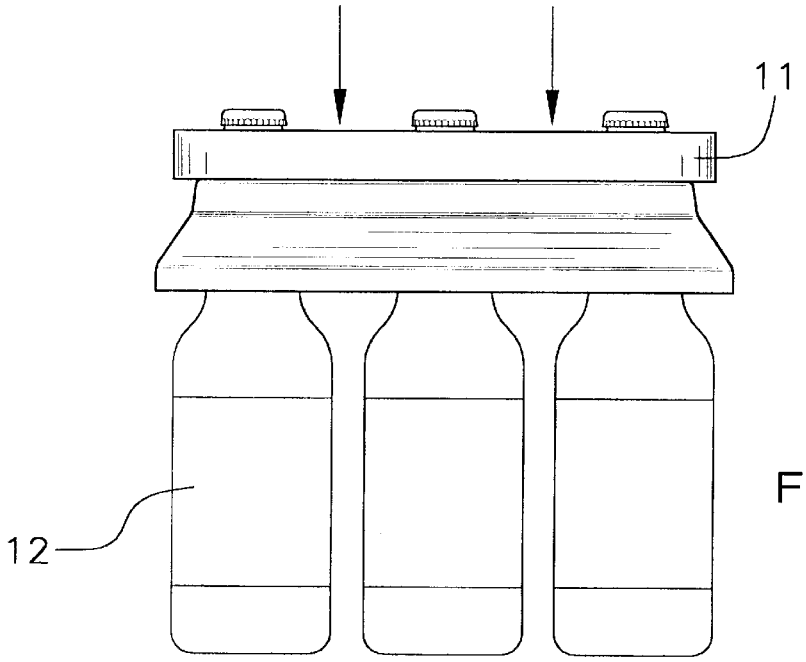
FIG. 4 is a side view of the present invention.

With reference now to the drawings, and in particular to FIGS. 1 through 4 thereof, a new bottle carrier system embodying the principles and concepts of the present invention and generally designated by the reference numeral 10 will be described.

As best illustrated in FIGS. 1 through 4, the bottle carrier system 10 generally comprises a plurality of bottles 12. A bottle carrier 11 has a plurality of apertures 14, each aperture 14 is structured to frictionally engage a top 16 of an associated one of the plurality of bottles 12 when the top 16 of the associated one of the bottles 12 is inserted through the aperture 14. A rigid planar member 18 has a plurality of holes 20. Each of the holes 20 is positioned to align with an associated one of the apertures 14 when the rigid planar member 18 is positioned over the bottle carrier 11, whereby applying a downward force to the rigid planar member 18 when the bottle carrier 11 is positioned between the plurality of bottles 12 and the rigid planar member 18 urges the top of each the bottles 12 through the associated aperture 14 to secure the bottle carrier 11 to the plurality of bottles 12.

The rigid planar member 18 is structured to include a pair of finger openings 22 each adapted for receiving a finger of a hand therethrough for facilitating lifting of the rigid planar member 18 from the bottle carrier 11 after securing the bottle carrier 11 to the plurality of bottles 12.

The plurality of holes 20 is six holes arranged into two rows of three holes. The three holes in each row are spaced to provide bearing surfaces between adjacently positioned holes for receiving the downward force.

The holes 20 in the rigid planar member 18 are symmetrically arranged with respect to a longitudinal axis and with respect to a transverse axis of the rigid planar member 18 for facilitating even distribution of the downward force about a center of the rigid planar member 18 to prevent tipping over of the bottles 12 while securing the bottle carrier 11 to the plurality of bottles 12.

In use, a user would simply open a 24-bottle cardboard box and place a plastic six pack tray on top of six bottles. The present invention could then be used to press downward on the plastic tray. This would cause the tray to be anchored on all six bottles in one quick easy motion.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bottle carrier application system comprising:

a plurality of bottles;

a bottle carrier having a plurality of apertures, each aperture being structured to frictionally engage a top of an associated one of said plurality of bottles when said top of said associated one of said bottles is inserted through said aperture;

a rigid planar member having a plurality of holes, each of said holes being positioned to align with an associated one of said apertures when said rigid planar member is positioned over said bottle carrier whereby applying a downward force to said rigid planar member when said bottle carrier is positioned between said plurality of bottles and said rigid planar member urges said top of each said bottle through said associated aperture to secure said bottle carrier to said plurality of bottles; and said rigid planar member being structured to include a pair of finger openings each adapted for receiving a finger of a hand therethrough for facilitating lifting of said rigid planar member from said bottle carrier after securing said bottle carrier to said plurality of bottles.

2. The bottle carrier application system of claim 1 wherein said plurality of holes is six holes arranged into two rows of three holes, said three holes in each row being spaced to provide bearing surfaces between adjacently positioned holes for receiving said downward force.

3. The bottle carrier application system of claim 2 wherein said two rows of three holes are aligned with respect to each other whereby said bearing surfaces are aligned to facilitate even distribution of said downward force about a longitudinal axis of said rigid planar member.

4. The bottle carrier application system of claim 2 wherein said holes in said rigid planar member are symmetrically arranged with respect to a longitudinal axis and with respect to a transverse axis of said rigid planar member for facilitating even distribution of said downward force about a center of said rigid planar member to prevent tipping over of said bottles while securing said bottle carrier to said plurality of bottles.

5. A bottle carrier application system comprising:

a plurality of bottles;

a bottle carrier having a plurality of apertures, each aperture being structured to frictionally engage a top of an associated one of said plurality of bottles when said top of said associated one of said bottles is inserted through said aperture;

a rigid planar member having a plurality of holes, each of said holes being positioned to align with an associated one of said apertures when said rigid planar member is positioned over said bottle carrier whereby applying a downward force to said rigid planar member when said bottle carrier is positioned between said plurality of bottles and said rigid planar member urges said top of each said bottle through said associated aperture to secure said bottle carrier to said plurality of bottles;

said rigid planar member being structured to include a pair of finger openings each adapted for receiving a finger of a hand therethrough for facilitating lifting of said rigid planar member from said bottle carrier after securing said bottle carrier to said plurality of bottles;

wherein said plurality of holes is six holes arranged into two rows of three holes, said three holes in each row being spaced to provide bearing surfaces between adjacently positioned holes for receiving said downward force; and wherein said holes in said rigid planar member are symmetrically arranged with respect to a longitudinal axis and with respect to a transverse axis of said rigid planar member for facilitating even distribution of said downward force about a center of said rigid planar member to prevent tipping over of said bottles while securing said bottle carrier to said plurality of bottles.

6. A method of applying a bottle carrier to a plurality of bottles, the steps of the method comprising:

providing a plurality of bottles;

providing a bottle carrier having a plurality of apertures, each aperture being structured to frictionally engage a top of an associated one of said plurality of bottles when said top of said associated one of said bottles is inserted through said aperture;

providing a rigid planar member having a plurality of holes, each of said holes being positioned to align with an associated one of said apertures when said rigid planar member is positioned over said bottle carrier, said rigid planar member being structured to include a pair of finger openings each adapted for receiving a finger of a hand therethrough for facilitating lifting of said rigid planar member from said bottle carrier after securing said bottle carrier to said plurality of bottles;

arranging said plurality of bottles;

positioning said bottle carrier over said arranged plurality of bottles such that each aperture is positioned over an associated one of said arranged plurality of bottles;

positioning said rigid planar member on said bottle carrier;

applying a downward force to said rigid planar member when said bottle carrier is positioned between said plurality of bottles whereby said rigid planar member urges said top of each said bottle through said associated aperture to secure said bottle carrier to said plurality of bottles.

* * * * *